United States Patent [19]

Jenkins

[11] 4,319,980

[45] Mar. 16, 1982

[54] METHOD FOR TREATING COAL TO OBTAIN A REFINED CARBONACEOUS MATERIAL

[76] Inventor: Rodman Jenkins, Suite 558, 1629 K St., NW., Washington, D.C. 20006

[21] Appl. No.: 128,127

[22] Filed: Mar. 7, 1980

[51] Int. Cl.[3] ..... C10G 1/04; C10L 5/00

[52] U.S. Cl. ..... 208/8 LE; 44/1 B; 203/66

[58] Field of Search ..... 208/8 LE, 9, 10; 201/17; 44/1 B; 203/66

[56] References Cited

U.S. PATENT DOCUMENTS

| | | | |
|---|---|---|---|
| 3,558,468 | 1/1971 | Wise | 208/8 |
| 3,607,717 | 9/1971 | Roach | 208/8 |
| 4,029,567 | 6/1977 | Farnand et al. | 208/8 |
| 4,095,955 | 6/1978 | Stambaugh | 201/17 |

OTHER PUBLICATIONS

*Action of Solvents on Coals at Lower Temperatures,* I. G. C. Dryden, "Fuel", vol. XXX, 2, pp. 39–44, (1949).

*Primary Examiner*—P. E. Konopka

*Attorney, Agent, or Firm*—James J. Brown

[57] ABSTRACT

A process is described for obtaining a refined, carbonaceous product from essentially raw coal by treating the coal with an amine solution to dissolve a portion of the coal, leaving undissolved coal and waste material such as ash. The dissolved coal is separated from the undissolved components and the amine removed to leave the refined carbonaceous extract of the invention. The undissolved coal and waste are separated and amine removed from the undissolved coal to produce a residue. Amine is advantageously recovered for further use. Prior to treatment with amine the coal may be subjected to pre-treatment such as crushing, drying or digestion in alkali metal carbonate solution. Residual amine is advantageously removed from the refined product and residue by stripping with alcohol.

9 Claims, 3 Drawing Figures

COAL FROM MINE
A
CRUSHER
1
B
C
AIR
4
2
DRIER
8
6
CYCLONE
7
D
WET FLUE GAS TO VENT
E
5
F
9
EXTRACTOR
10
12
G
SETTLER
13
H
11
GANGUE (ASH)
14
16
15
17
RESIDUE
K
CENTRIFUGE EXTRACT
L
M
J'
22
METHANOL WASH FLASH
24
21
N
18
RESIDUE FLASH
CYCLONE
19
O
20
RESIDUE STRIPPER
25
O'
TO FIG. 1A

METHOD FOR TREATING COAL TO OBTAIN A REFINED CARBONACEOUS MATERIAL

BRIEF SUMMARY OF THE INVENTION

The present invention relates to a process for obtaining a refined, nearly ash-free carbonaceous extract from coal by dispersing coal in a low molecular weight, primary amine followed by separation of the dissolved and undissolved components and treatment with a low molecular weight liquid such as an alcohol or naphtha and evaporation to remove the amine, which can be recycled for further use.

BACKGROUND OF THE INVENTION

Utilization of coal as an energy source in the U.S. has been hindered by its content of sulfur and ash, which produce undesirable emissions on combustion and increase furnace maintenance, and by the fact that, as a solid, coal is more difficult to handle than liquid or gaseous fuels. For this reason, conversion of coal into liquid or gaseous "synthetic fuels" has, and continues to be the subject of intensive research and development work. In liquefaction, the overwhelming majority of the effort has been on high pressure hydrogenation, sometimes called hydroliquefaction, processes. These processes are relatively expensive, and the cost of the synthetic crude oil they would produce is in the same range ($20—$40/bbl) is the natural petroleum it would replace. These high costs are due to the high pressure and temperatures required, use of expensive stainless steel to resist corrosion and erosion, and the consumption of expensive hydrogen by the process.

At the present time, there is a major difference in price in the United States between low sulfur, nearly ash-free fuels (so-called "compliance" fuels), and surface mined coal, the former selling for about four times the latter, per unit of heating value.

A very attractive alternative to hydroliquefaction lies in the extraction of nearly ash-free carbonaceous solids from coal by alkaline solvents or mixtures under relatively mild conditions. One example of such a process is described by E. P. Stambaugh in U.S. Pat. No. 4,121,910. This process uses aqueous alkalies at elevated temperatures (such as 270° C.) and pressures, and after acid-washing, the ash content of the product is reduced to the range of 0.5–1.0%.

The extraction of coal by organic bases, particularly ethylene diamine and pyridine has also been described extensively in the scientific literature, but has not been used commercially. These particular solvents are relatively expensive and difficult to remove completely from the coal, so that the cost of solvent makeup is large.

Coal extracts obtained with organic bases are, however, lower in ash than those produced by aqueous alkali; ash values of 0.1 WT% or less have been achieved. A high degree of sulfur removal is not achieved, but since U.S. sub-bituminous coals and lignite are naturally low in sulfur, a high value, low sulfur, nearly ash-free product could be produced, which with proper selection and operation of solid-liquid separation equipment, could produce a fuel suitable for use in automotive diesel engines.

An objective of this invention is to describe a commercially viable process for extraction of low rank coals with low-molecular weight primary amines to produce a nearly ash-free extract, with nearly complete solvent recovery and, therefore, reduced cost.

DESCRIPTION OF THE INVENTION

Figure 1:
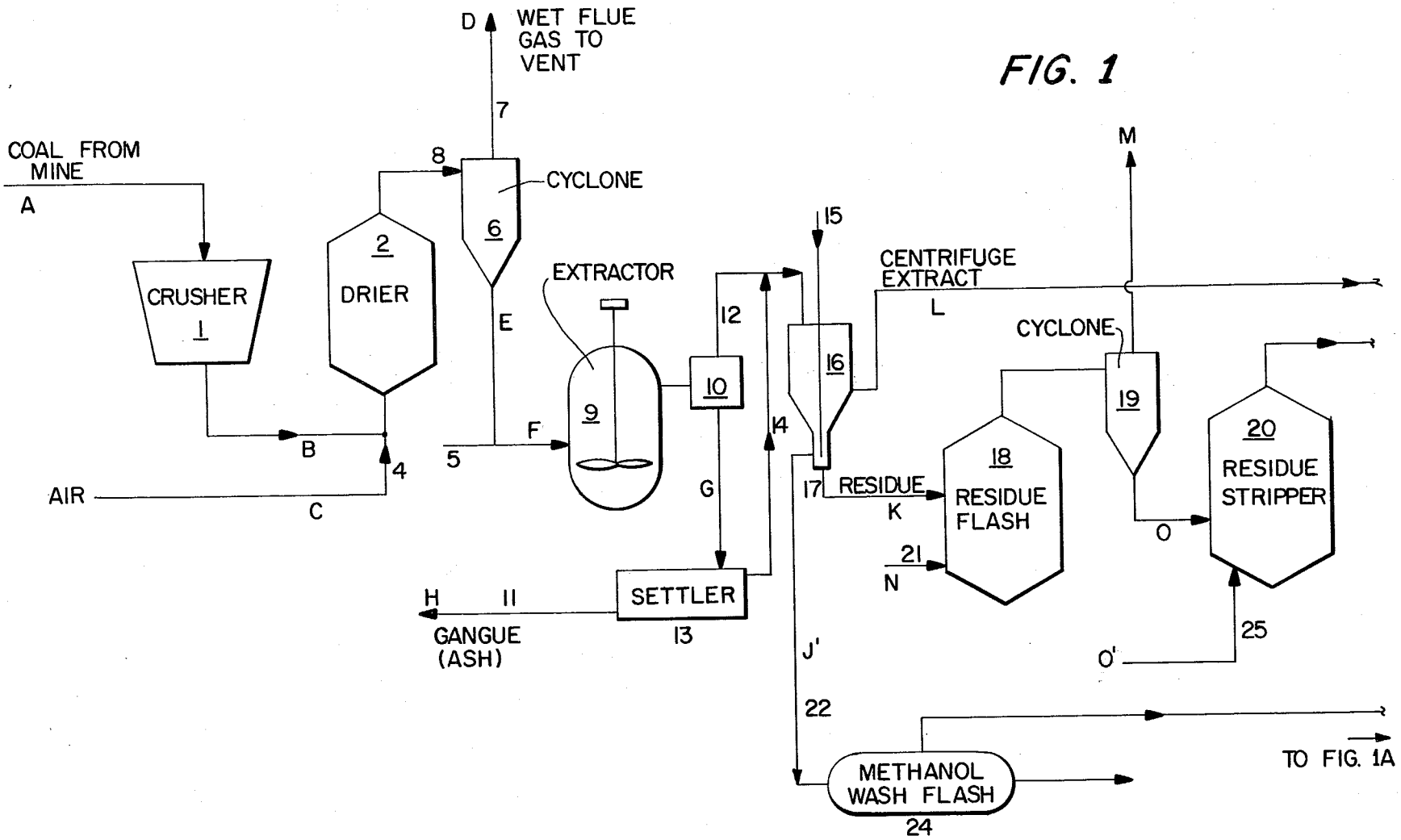
FIG. 1 is a flow diagram showing an amine extraction according to the invention.
Figure 1A:
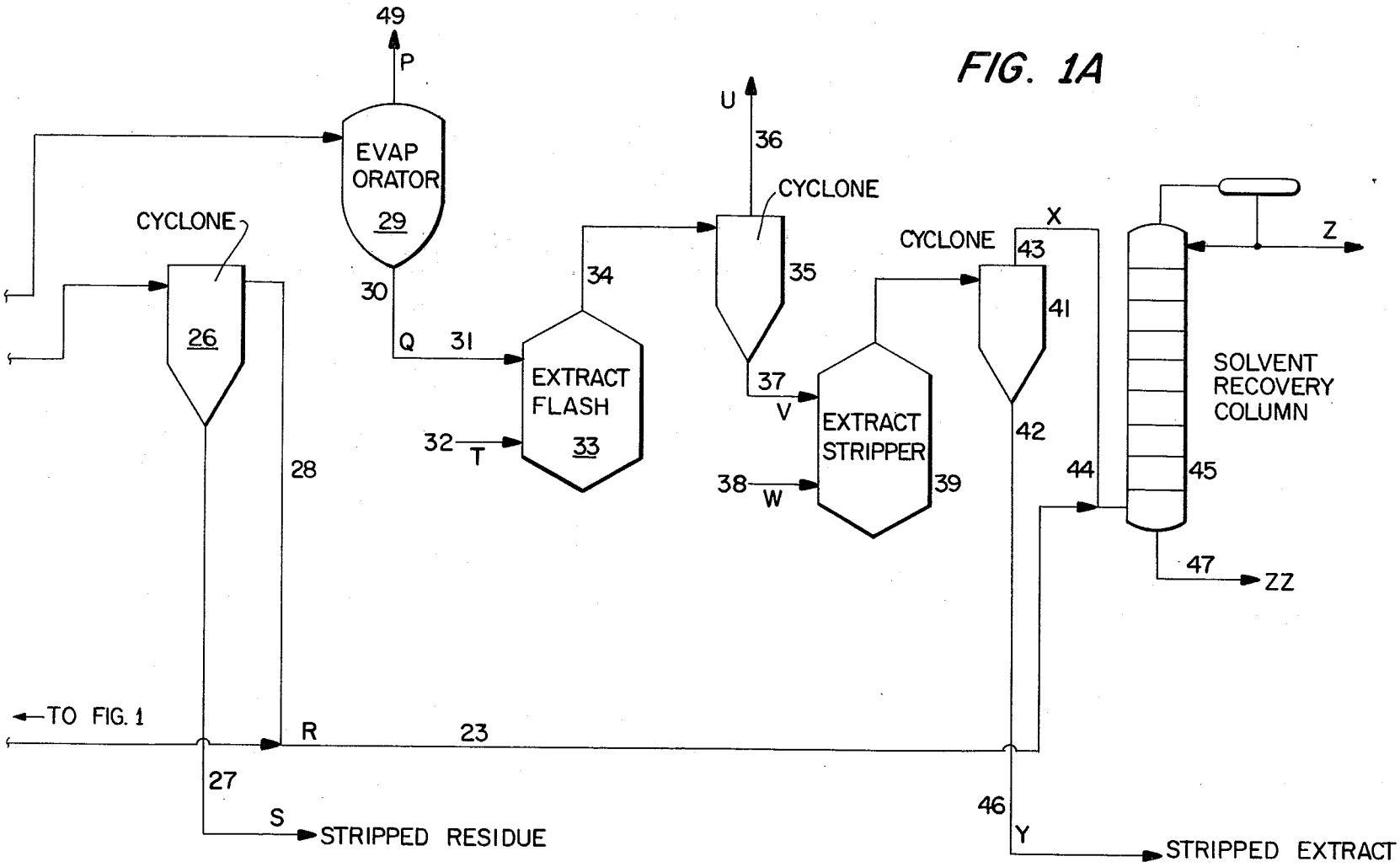

According to the present invention a process is provided for producing a refined carbonaceous material from coal which comprises in essence treating the coal with a solution of a low molecular weight primary aliphatic amine solvent at a temperature of about 50° to 200° C., preferably about 60° to 150° C. to dissolve a portion of the coal while leaving a residue of undissolved coal and insoluble waste material. The insoluble waste is discarded and the solution of dissolved coal is separated from the undissolved coal which is then treated with a vaporized low molecular weight alcohol or naphtha to remove residual amine. In a separate operation the amine is also separated from the solution of dissolved coal to produce a highly refined carbonaceous product.

It will of course be understood that it is highly desirable according to the present invention to recover and recycle solvents and other liquids which are used in the process. Exemplary procedures for carrying out these operations will become apparent from the discussion below.

It will further be apparent that various procedures and combinations of procedures can advantageously be employed according to the present invention to separate the amine from the dissolved carbonaceous product to produce an essentially dry material while permitting re-use of the recovered amine.

Although the present invention contemplates the treatment of essentially unrefined coal, and is particularly effective in treating sub-bituminous or lignite coal, to produce the high grade refined carbonaceous product of the invention, several preliminary procedures are desirable to prepare the raw coal in order to maximize the effectiveness of the process of the invention. For example, the coal may be first crushed to a size of 20–100 mesh and dried to reduce the moisture content to a level of about 1–2%, or less. Drying of the crushed coal may for example be carried out in a conventional dryer at a temperature of about 350°–400° F., which drying procedure may involve actual burning of 10–15% of the total amount of coal in order to provide the necessary drying heat.

The low molecular weight aliphatic amine employed according to the present invention is typically an amine of 1–3 carbon atoms such as methylamine. It is especially desirable that the amine used have sufficient volatility to permit it to be essentially completely removed from the coal by vaporizing or stripping. Preferably the boiling point of the amine will not exceed about 100° C. Typically 1.5 to 5 parts by weight of amine are used per one part of coal. The liquid used according to the invention to remove the amine may be naphtha or an alcohol of from 1–4 carbon atoms such as methanol.

Additionally, it may be desirable and is considered within the contemplation of the present invention to subject the coal to a pre-treatment with about an equal amount by weight of a hot concentrated aqueous or alcoholic solution of an alkali metal carbonate such as sodium carbonate at a temperature of about 100° to 150° C. which results in obtaining a refined extract from which the carbonate solution can be removed for re-use and a residue containing substantial coal values which can be subjected to treatment with amine solution in accordance with the procedure heretofore described. The resulting residue which can be further treated by the amine is of reduced molecular weight and possesses greater solubility in the amine solution thereby resulting in a greater level of extraction and enhanced yield of refined carbonaceous material.

DETAILED DESCRIPTION OF THE DRAWINGS

Further understanding of the present invention, will, however, be gained by having reference to FIG. 1 of the drawings which is a flow diagram of an exemplary procedure of the invention.

As illustrated in FIG. 1, raw coal enters a crushing mechanism 1, where it is reduced in size to about 20 to 100 mesh and is then conveyed to a dryer 2 in which a substantial portion of moisture in the raw coal is removed. Air is provided to the dryer by line 4. From the dryer the crushed dry coal enters by way of line 8 a cyclone 6 in which flue gas is separated off from the coal and vented at 7. The coal is removed from the cyclone and mixed with methylamine solvent which is introduced at 5 at a temperature of about 70° C. in a ratio of about 2 parts solvent to one part coal and then is passed into extractor 9. In the extractor about 40% of the coal is dissolved in methylamine solvent leaving about 60% undissolved coal and residue containing a substantial portion of gangue or ash. The entire mixture of dissolved and undissolved coal and residue is passed from the extractor to a centrifuge 10 where the dissolved and undissolved coal together with the methylamine solvent are removed at 12 while the residue containing gangue is removed at 11 and passed to a settler 13 for separation of the gangue from entrained solvent. The solvent from the settler 13 is removed at line 14 and is reunited with the stream 12 of dissolved and undissolved coal which is passed to centrifuge 16. In the centrifuge 16, the extract consisting of methylamine solvent and dissolved coal is separated and removed from the residue which consists of undissolved, ash containing coal. A wash liquid consisting of methanol is introduced at 15 to strip residual methylamine from the residue. This methanol is removed at 22 and separated from entrained methylamine solvent by flashing off the solvent at 24. The residue from the centrifuge 16 is removed at 17 to a suitable device 18 for separating further solvent such as by flashing at a temperature of about 250° F. The heat for this separation can, for example, be provided by introducing hot methylamine vapor to assist in vaporizing any residual solvent that is present although other means for providing the required heat such as heating coils can also be employed. The solvent which is removed is separated out by means of cyclone 19 and the residue is passed to a stripper 20 where it is subjected to further removal of residual solvent such as by introducing hot methanol vapor from line 25. Separation of the stripped residue from the solvent and hot methanol takes place in cyclone 26. The solvent is removed from the cyclone by line 28 and is then reunited in line 23 with methanol from previous solvent separations. The residue from the cyclone is removed from the system at 27. The extracted coal dissolved in methylamine solvent which was removed from the centrifuge 16 is passed to evaporator 29 where the solvent is vaporized at a temperature of about 80° F. and removed from the evaporator at 49. The refined coal product together with entrained methylamine solvent is removed from the evaporator at 30 and passed to a heat exchanger 31 where it is heated to a temperature of about 300° F. From this heat exchanger the refined material passes to flash vessel 33 where it is flashed to remove additional solvent such as, for example, by introducing hot solvent vapor at a temperature of 250° to 300° F. at 32. The material removed from flash vessel 33 is passed by line 34 to cyclone 25 where the actual separation of the solvent from the refined material takes place with the solvent being removed at 36 and the refined material at 37. This material is then passed to stripper 39 where additional methanol is added at 38. Material from the stripper 39 is removed to cyclone 41 where solvent and methanol are removed in line 43 and the stripped extract removed at 42 and passed out of the system at 46. The combined mixture of solvent and methanol from lines 23 and 44 are passed to a solvent recovery system 45 which separates the methanol for removal at 47. The methylamine solvent is removed from the system at 48. These solvents as well as those previously extracted from the system can be recovered for reuse in the procedures heretofore set forth. The stripped extract which is removed from the system at line 46 is a very high grade, nearly moisture and ash-free carbonaceous product.

As previously noted, the coal to be treated according to the process of the present invention can advantageously be subjected to a pre-treatment with alkali metal carbonate or hydroxide solution. Suitable carbonates and hydroxides, for example, are those of sodium or potassium. This pre-treatment is by no means mandatory but does increase the level of extraction of the coal thereby resulting in an enhanced yield of refined carbonaceous product.

Figure 2:
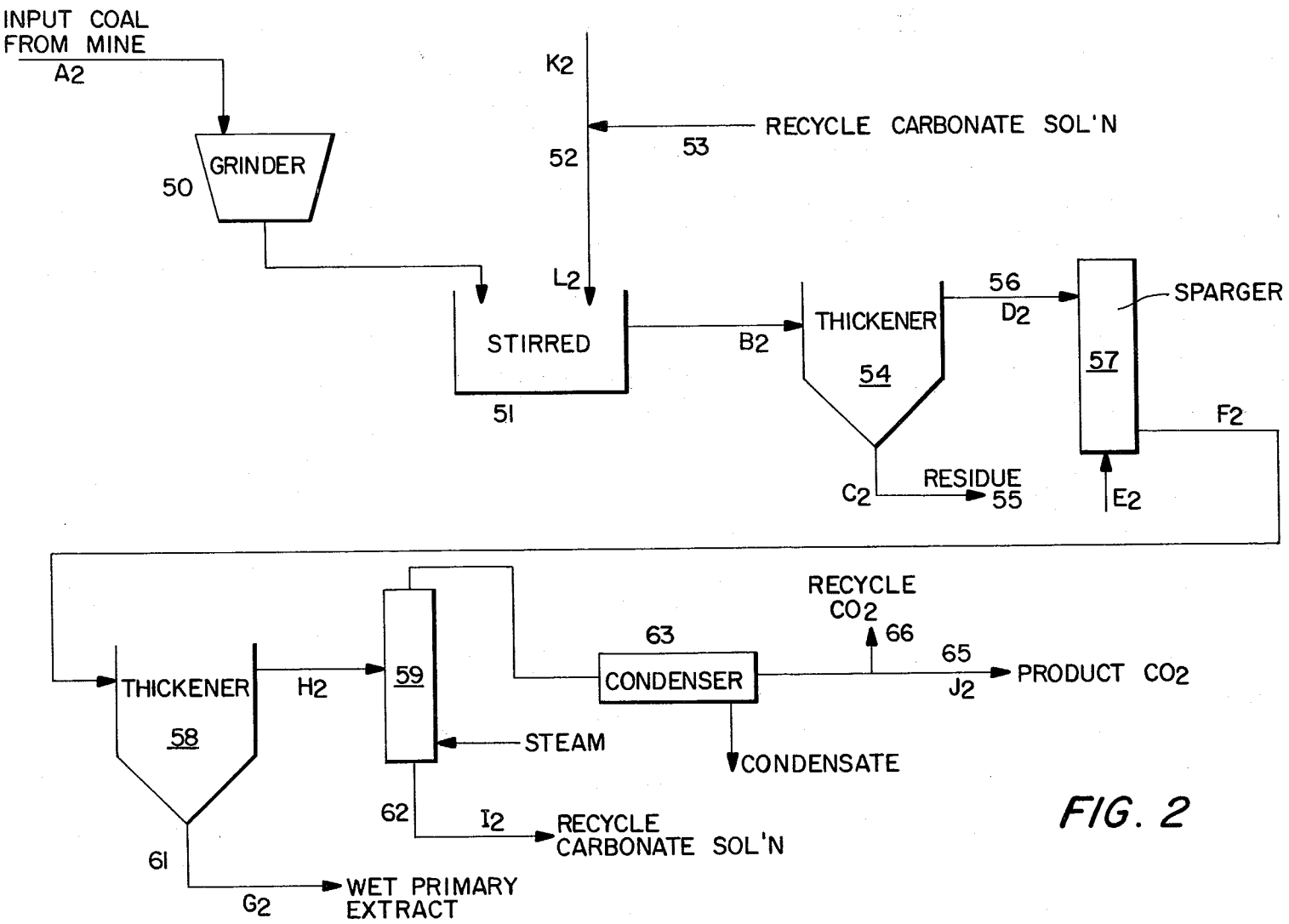
FIG. 2 is a flow diagram showing a sodium carbonate pre-treatment of coal prior to amine extraction.

Directing attention to FIG. 2, raw coal is subjected to a grinding procedure at 50 which reduces its size to between about 20 to 40 mesh. The ground coal is then passed to a stirring tank 51 which is maintained at a temperature of about 200° F. and an aqueous solution of soldium carbonate added to the tank at 52. In addition, recycled carbonate solution from other or previous operations can also be introduced at this point. The mixing of the crushed coal and sodium carbonate solution results in extractions of a portion of the coal into the carbonate solution. The contents of tank 51 are passed to a thickener 54 where the extracted coal in the sodium carbonate solution is separated from the residue and ash. This residue which is removed at 55 from the thickener 54 can then be directed to the amine extracting procedure previously described for futher extraction of refined carbonaceous material. The extracted coal and carbonate solution are removed from the thickener by line 56 and passed to a sparger 57 where they are subjected to treatment with carbon dioxide which converts a substantial portion of the alkali metal carbonate or bicarbonate. The entire material from the sparger 57 including the carbonaceous extract in solution is then passed to a thickener 58 where the extract consisting of the refined coal is removed at 61. The remaining material consisting primarily of water and alkali metal bicarbonate with a small amount of carbonate is then treated with steam at 59 to produce a carbonate solution which is removed at 62 for recycling to stirring tank 51 and water which is condensed in condenser 63 and removed. The carbon dioxide which is removed from the system can be diverted into products stream 65 or recycle stream 66 for return to sparger 57.

Tables 1 and 2 illustrate, respectively, the composition typically found at various stages identified by letters A–ZZ and $A_2$–$L_2$ in the procedures of FIGS. 1 and 2, respectively based on an initial introduction of raw coal in the process of FIGS. 1 and 2 of 10,000 units. The ultimate primary refined product in both cases is identified as "extract".

It will of course be appreciated by those skilled in the art that the present invention contemplates that alternate procedures known in the art may be employed in the present invention where appropriate without departing from the spirit or scope of the invention.

TABLE 1

| STREAM | A | B | C | D | E | F | G | H | I | J | K | L | J' | M | N |
|---|---|---|---|---|---|---|---|---|---|---|---|---|---|---|---|
| COAL (MAF) | 8000 | 8000 | | | 7100 | 7100 | 40 | 40 | | | | | | | |
| EXTRACT | | | | | | | | | 2840 | | | 2840 | | | |
| RESIDUE | | | | | | | | | 4220 | | 4220 | | | | |
| GANGUE | 1000 | 1000 | | | 888 | 888 | 352 | 352 | 536 | | 533 | 3 | | | |
| WATER | 1000 | 1000 | | | 81 | 81 | | | 81 | | 48 | 33 | | | |
| AIR | | | 1816 | | | | | | | | | | | | |
| FLUE GAS | | | | 1931 | | | | | | | | | | | |
| SOLVENT | | | | | | 16138 | 784 | | 15354 | | 1093 | 14886 | 159 | 2887 | 22586 |
| METHANOL | | | | | | | | | | 1425 | 143 | | 1282 | | |
| TOTAL | 10,000 | 10,000 | 1816 | 1931 | 8069 | 24207 | 1176 | 392 | 23031 | 1425 | 6037 | 17762 | 1441 | 2887 | 22586 |
| TEMP. °F. | 60 | 65 | | | | | | | | | | | | | |
| PRESSURE - PSIG | 0 | 0 | | | | 215 | 215 | 0 | | | | | | | 50 |

| STREAM | O | P | Q | R | S | T | U | V | W | X | Y | Z | ZZ | O' |
|---|---|---|---|---|---|---|---|---|---|---|---|---|---|---|
| COAL (MAF) | | | | | | | | | | | | | | |
| EXTRACT | | | 2840 | | | | | 2840 | | | 2840 | | | |
| RESIDUE | 4220 | | | | 4220 | | | | | | | | | |
| GANGUE | 533 | | 3 | | 533 | | | 3 | | | 3 | | | |
| WATER | 48 | | 33 | | 48 | | | 33 | | | 33 | | | |
| AIR | | | | | | | | | | | | | | |
| FLUE GAS | | | | | | | | | | | | | | |
| SOLVENT | 792 | 11371 | 3515 | 787 | 5 | 15200 | 18182 | 533 | | 530 | 3 | 1149 | 168 | |
| METHANOL | | | | 19393 | | | | | 13060 | 13060 | | 169 | 33566 | 19393 |
| TOTAL | 5593 | 11371 | 6391 | 20180 | 4806 | 15200 | 18182 | 3409 | 13060 | 13590 | 2879 | 1318 | 33734 | 19393 |
| TEMP. °F. | | | | | | 250 | 250 | 250 | | 292 | | | | |
| PRESSURE - PSIG | | | | | | 47 | 45 | 45 | 10 | 5 | | | | |

TABLE 2

| | $A_2$ | $B_2$ | Ca | $D_2$ | $E_2$ | $F_2$ | $G_2$ | $H_2$ | Ia | $J_2$ | $K_2$ | $L_2$ |
|---|---|---|---|---|---|---|---|---|---|---|---|---|
| COAL | 8000 | | | | | | | | | | | |
| EXTRACT | | 1600 | | 1600 | | 1600 | 1600 | | | | | |
| RESIDUE | | 6200 | 6200 | | | | | | | | | |
| $H_2O$ | 1000 | 17917 | 1800 | 16117 | | 15715 | 400 | 15315 | 15799 | | | 17000 |
| AsH | 1000 | 1000 | 998 | 1,6 | | 1,6 | 1,6 | | | | | |
| $Na_2CO_3$ | | 2519 | 31 | 2488 | | 119 | 16 | 103 | 2954 | | 36 | 3000 |
| Na $HCO_3$ | | 764 | | 764 | | 4519 | | 4519 | | | | |
| $CO_2$ | | | | | 984 | | | | | 200 | | |
| TOTAL | 10000 | 30000 | 9029 | 20971 | 984 | 21955 | 2018 | 19937 | 18753 | 200 | 36 | 20000 |

What I claim is:

1. A process for producing a refined carbonaceous material from initial coal which comprises:

(1) treating said coal at a temperature of 60° to 150° C. with methylamine to produce a mixture comprising:

(a) insoluble waste material (b) a solution of extracted coal and (c) undissolved residual coal (2) discarding said insoluble waste (a) and separating said solution of extracted coal from said undissolved coal;

(3) subjecting said undissolved residual coal to a first treatment to remove a predominant amount of amine and then stripping said undissolved coal with a low molecular weight alcohol or naphtha vapor to remove remaining residual amine;

(4) removing said amine from said extracted coal solution to produce a refined carbonaceous product.

2. The process of claim 1 wherein said alcohol is of 1–4 carbons.

3. The process of claim 1 wherein said alcohol is methanol.

4. The process of claim 1 wherein said initial coal is subjected to a drying and crushing treatment prior to being treated with amine whereby the moisture content is reduced to about 1 to 2% and the particle size is reduced to 20–100 mesh.

5. The process of claim 1 wherein said methylamine and alcohol or naphtha subsequent to use in steps 1–4 are recovered and recycled for further use in the process.

6. The process of claim 1 wherein prior to treatment with methylamine, said coal is pre-treated with a hot, concentrated solution of an alkali metal carbonate to form a solution of dissolved, extracted coal in said carbonate solution along with undissolved waste and undissolved coal residue; said undissolved coal residue thus being separated from said waste and solution of dissolved extract and passed to step 1 for treatment with said amine.

7. The process of claim 1 wherein said refined carbonaceous product consists essentially of moisture and ash-free coal.

8. The process of claim 1 wherein the initial coal which is treated is sub-bituminous or lignite coal.

9. A process for producing a refined carbonaceous material from coal which comprises:

(1) treating said coal at a temperature of 60° to 150° C. with methylamine to produce a mixture comprising:

(a) insoluble waste material and (b) a solution of dissolved extracted coal and (c) undissolved residual coal (2) discarding said insoluble waste (a) and separating said extract solution from said undissolved residual coal;

(3) subjecting said undissolved coal to a first treatment to remove a predominant amount of said methylamine and then stripping said undissolved coal with methanol to remove residual methylamine;

(4) treating said undissolved residual coal from (3) with additional hot methylamine, and then separating methylamine from said residual coal;

(5) subjecting said undissolved residual coal from (4) with hot methanol vapor to strip away remaining methylamine and then separating said residual coal from the methanol-methylamine mixture;

(6) removing methylamine from said dissolved extracted coal solution to produce a refined carbonaceous product.

* * * * *